US007055564B2

(12) United States Patent
Carey et al.

(10) Patent No.: US 7,055,564 B2
(45) Date of Patent: Jun. 6, 2006

(54) HOST ORGANIZER WITH REMOVABLY ATTACHED ARTICLE

(75) Inventors: Jacqueline M. Carey, Unadilla, NY (US); Duane D. Adams, Sidney, NY (US)

(73) Assignee: MeadWestvaco Corporation, Stamford, CT (US)

( * ) Notice: Subject to any disclaimer, the term of this patent is extended or adjusted under 35 U.S.C. 154(b) by 110 days.

(21) Appl. No.: 10/625,497

(22) Filed: Jul. 23, 2003

(65) Prior Publication Data

US 2005/0016647 A1 Jan. 27, 2005

(51) Int. Cl.
*A45C 1/02* (2006.01)

(52) U.S. Cl. ..... 150/113; 150/111; 402/73

(58) Field of Classification Search ..... 150/113, 150/105, 112, 103, 111; 192/108; 402/73
See application file for complete search history.

(56) References Cited

U.S. PATENT DOCUMENTS

| | | | | | |
|---|---|---|---|---|---|
| 1,425,217 | A | * | 8/1922 | Regulski | 150/111 |
| 2,544,493 | A | * | 3/1951 | Filenbaum | 150/111 |
| 2,721,596 | A | * | 10/1955 | Danneil | 150/106 |
| D183,711 | S | * | 10/1958 | Blaivas | D3/233 |
| 3,696,850 | A | * | 10/1972 | Rosenblum | 190/108 |
| D227,818 | S | | 7/1973 | Dipadova | |
| 4,192,365 | A | * | 3/1980 | Siegel | 150/111 |
| 4,250,938 | A | * | 2/1981 | Siegel | 150/111 |
| 4,257,463 | A | | 3/1981 | Monaco | |
| 4,263,951 | A | * | 4/1981 | Siegel | 150/111 |
| 4,907,634 | A | | 3/1990 | Yoo | |
| 5,489,021 | A | | 2/1996 | Wallingford | |
| 5,865,314 | A | * | 2/1999 | Jacober | 206/570 |
| 5,954,170 | A | | 9/1999 | Chisholm | |
| 6,012,557 | A | | 1/2000 | Derelanko | |
| 6,017,062 | A | | 1/2000 | White | |
| 6,161,979 | A | | 12/2000 | Yamamoto et al. | |
| 6,179,025 | B1 | | 1/2001 | Sutton | |
| 6,230,952 | B1 | * | 5/2001 | Jupiter | 224/655 |

OTHER PUBLICATIONS

PCT/US00/07210; Date: Sep. 21, 2000; Name: Moor, et al.

* cited by examiner

*Primary Examiner*—Tri M. Mai
(74) *Attorney, Agent, or Firm*—Lawrence P. Trapani

(57) ABSTRACT

A host organizer includes a casing, a pocket, and an organizer flap. The pocket is located on the exterior surface of the casing. The pocket contains a first attachment element. The organizer flap extends from the casing and over the pocket. The flap has a second attachment element. The second attachment element is complementary to and alignable with the first attachment element, such that the flap is releasably attachable to the pocket. An ancillary article includes a body and an article flap. The article flap contains third and fourth attachment elements. The third attachment element is complementary to the first element, and the fourth attachment element is complementary to the second element. The body is configured to fit in the organizer pocket. The article flap is adapted to overlap the organizer pocket such that the third and first attachment elements are aligned and the article flap is releasably attachable to the organizer pocket. The organizer flap is adapted to overlap the article flap such that the second and fourth attachment elements are aligned and the organizer flap is releasably attachable to the article flap.

12 Claims, 5 Drawing Sheets

HOST ORGANIZER WITH REMOVABLY ATTACHED ARTICLE

BACKGROUND OF THE INVENTION

1. Technical Field

The present invention relates generally to organizers, such as handbags, briefcases, loose-leaf and wire-bound binders and organizer systems, etc., and relates more particularly to such organizers with a capability for carrying an ancillary article, such as a wallet, purse, pouch, etc., external to the organizer.

2. Background Art

Organizers such as binders are used generally to store and carry paper-based organizing systems such as planners, calendars, diaries, and the like. People utilize these systems to help them plan and organize their daily activities. Usually, such planned activities require the use of an ancillary article such as a purse, wallet, carry bag, notepad, PDA (personal digital assistant), checkbook, and the like. Recognizing this fact, organizers have been proposed which provide additional capability for carrying such ancillary articles. For example, the following references disclose binder systems with such additional carrying capability: U.S. Pat. No. 6,161,979 to Yamamoto et al.; U.S. Pat. No. 6,017,062 to White; PCT Application PCT/US00/07210 to Moor et al.; U.S. Pat. No. 5,954,170 to Chisholm; and U.S. Pat. No. 5,489,021 to Wallingford. A similar approach has been taken with handbags; see, e.g., U.S. Pat. No. 4,250,938 to Siegel; U.S. Pat. No. 4,257,463 to Monaco; and U.S. Pat. No. 4,192,365 to Siegel.

While an additional carrying capability on an organizer has offered some convenience, further efforts have been made to make such capability even more convenient. For example, the above-cited patents to Wallingford, Siegel ('938), and Monaco disclose the concept of securing the ancillary article on the exterior of a binder or handbag. Wallingford actually secures purse-like articles to the exterior of a binder cover with hook-and-loop fasteners. Siegel ('938) provides a handbag containing a simple external pocket for securing a purse-like article. Monaco discloses a handbag with an exterior pocket for receiving a purse.

The added convenience of locating the ancillary article on the exterior of the host organizer (e.g., binder, handbag, briefcase, etc.) raises concerns about adequately securing such articles to the host. Wallingford secures the articles with hook-and-loop fasteners and encloses them with a flap also secured by hook-and-loop fasteners. Siegel ('938) secures the purse-like article by including a flap on the purse and inserting the flap into the external pocket. An alternate securing arrangement is shown in FIGS. 10 and 11 of Siegel ('938). Monaco secures the purse in the pocket by using snap fasteners. Despite the efforts disclosed in the above-noted patents, a need still exists for a more convenient and secure arrangement for carrying ancillary articles on a host organizer.

OBJECTS AND SUMMARY OF THE INVENTION

It is therefore an object of the present invention to provide a host organizer with a capability for carrying ancillary articles that avoids the limits and problems associated with the prior art.

It is another object of the present invention to provide a host organizer that offers convenient accesses to an ancillary article secured to the host.

It is a further object of the present invention to provide a host organizer that offers an improved means for securing an ancillary article to the host.

It is yet another object of the present invention to provide a combination host organizer and ancillary article in which the ancillary article is easily secured and removed from the host.

It is yet a further object of the present invention to provide a combination host organizer and ancillary article in which the ancillary article is secured to the host and the host is secured to the ancillary article.

These and other objects are attained in accordance with the present invention, wherein there is provided a host organizer and an ancillary article removably attached to the host organizer. The host organizer includes an organizer casing, an organizer pocket, and an organizer flap. The casing has an exterior surface and the organizer pocket is located on the exterior surface. The pocket has an exterior surface on which a first releasable attachment element is mounted. The organizer flap extends from the casing and over at least a portion of the exterior surface of the pocket. The flap has an interior surface on which a second releasable attachment element is mounted. The second attachment element is complementary to and alignable with the first attachment element, such that the flap is releasably attachable to the pocket.

The ancillary article includes a body and an article flap extending from the body. The article flap has interior and exterior surfaces on which third and fourth removable attachment elements are mounted, respectively. The third attachment element is complementary to the first attachment element, and the fourth attachment element is complementary to the second attachment element. The body is configured to fit in the organizer pocket. The article flap is adapted to overlap, at least partially, the organizer pocket such that the third and the first attachment elements are substantially aligned and the article flap is releasably attachable to the organizer pocket. The organizer flap is adapted to overlap, at least partially, the article flap such that the second and the fourth attachment elements are substantially aligned and the organizer flap is releasably attachable to the article flap.

BRIEF DESCRIPTION OF THE DRAWING

Further objects of the present invention will become apparent from the following description of the preferred embodiment with reference to the accompanying drawing, in which.

DETAILED DESCRIPTION OF THE PREFERRED EMBODIMENT

The present invention comprises, in combination, a host organizer and an ancillary article removably attached to the organizer. The present invention is not limited to any particular host organizer or ancillary article. For example, without limitation, the host organizer may be a binder, handbag, briefcase, portfolio case, or the like. The ancillary article may be, for example, a wallet, purse, pouch, PDA, calculator, electronic organizer, cell phone, notebook, checkbook, or the like.

Figure 1:
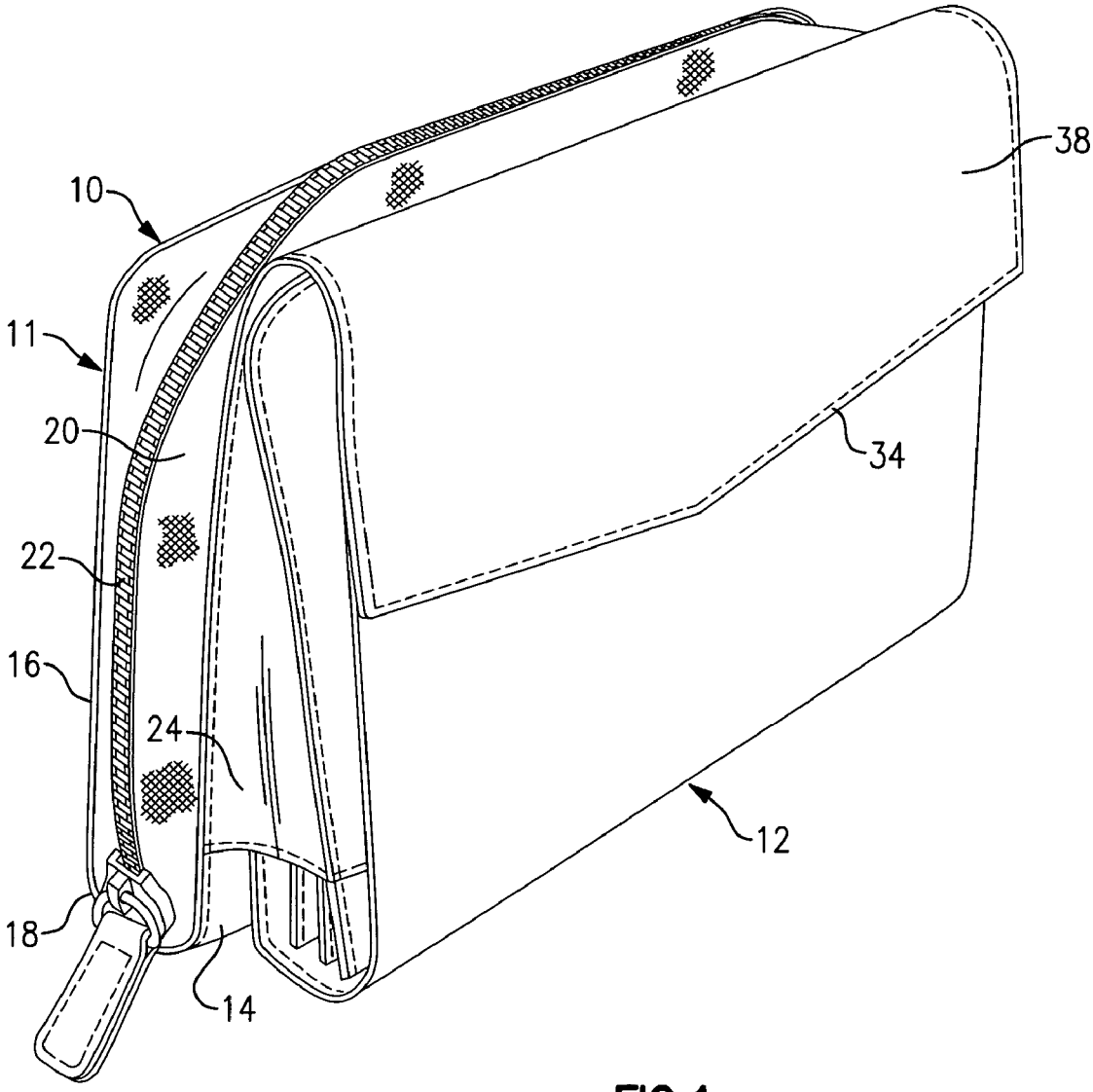
FIG. 1 is a perspective view of one embodiment of the present invention, which shows a binder and a wallet removably attached to the binder.
Figure 2:
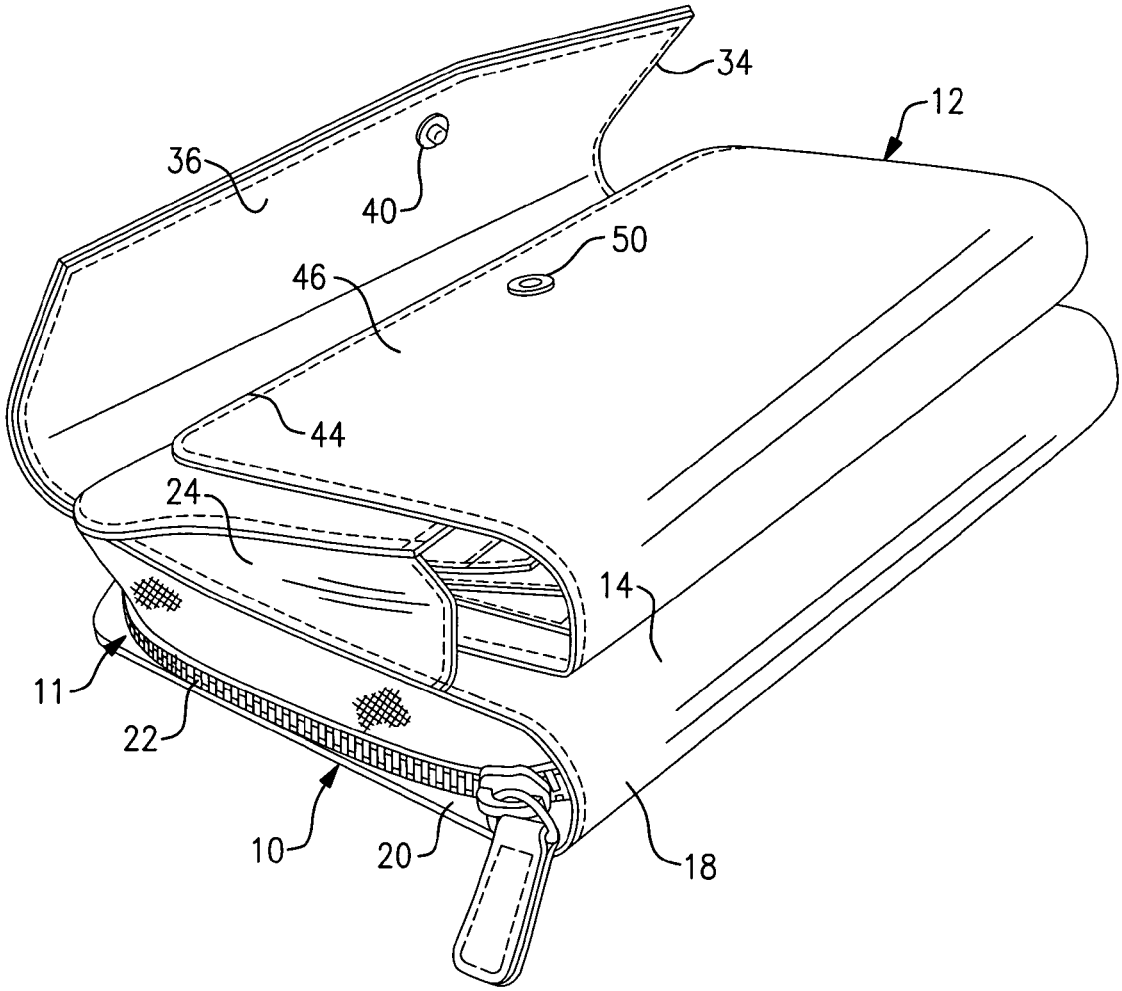
FIG. 2 is another perspective view of the embodiment of FIG. 1, showing a binder flap of the binder detached from the wallet.

Referring now to FIGS. 1 and 2, there is shown one embodiment of the present invention. In this embodiment, the host organizer is a binder 10 and the ancillary article is a wallet 12. Binder 10 includes front and rear covers 14 and 16 movably connect to a spine 18. Covers 14 and 16 are releasably held closed by a flexible webbing 20 and zipper 22. In general, the host organizer includes a casing, which is defined as the outer surrounding sides, bottom, and top of the organizer. The exterior surface of the casing is the outside or exposed (to view) surface of the casing. With respect to binder 10, the casing is the combined enclosure of covers 14 and 16, spine 18, webbing 20, and zipper 22. The exterior surfaces of covers 14 and 16 are those which are exposed to view from the outside of binder 10.

Inside binder 10 is a three-ring, loose-leaf binder mechanism (not shown) mounted on spine 18. The binder mechanism may hold a paper organizer system such as a planner, diary, calendar, address book, etc., or any combination of these systems. The construction of binder 10 is conventional, and thus, further details are not necessary for an understanding of the present invention.

Figure 3:
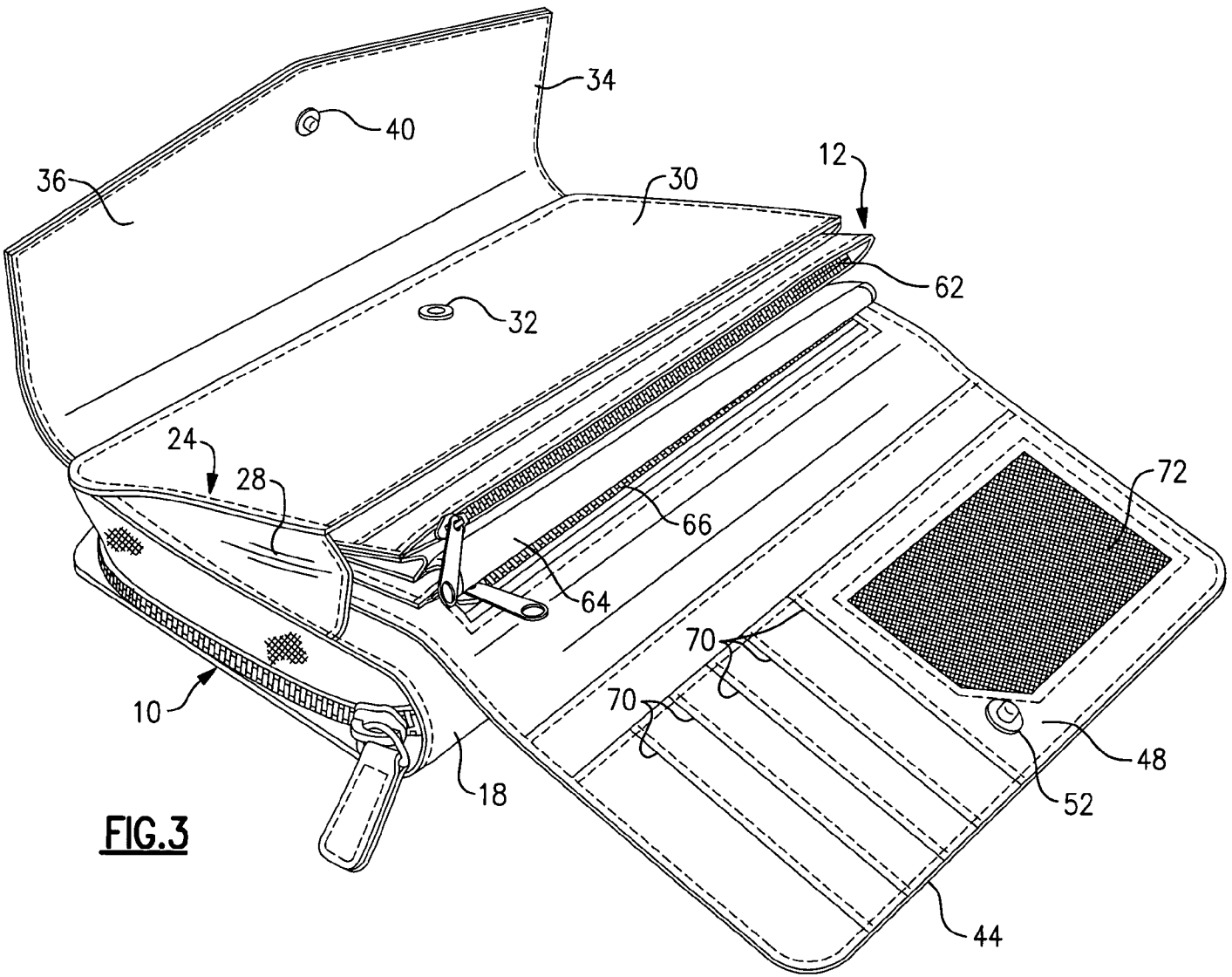
FIG. 3 is another perspective view of the embodiment of FIG. 1, showing the binder flap detached from the wallet and a wallet flap of the wallet detached from a binder pocket of the binder.
Figure 4:
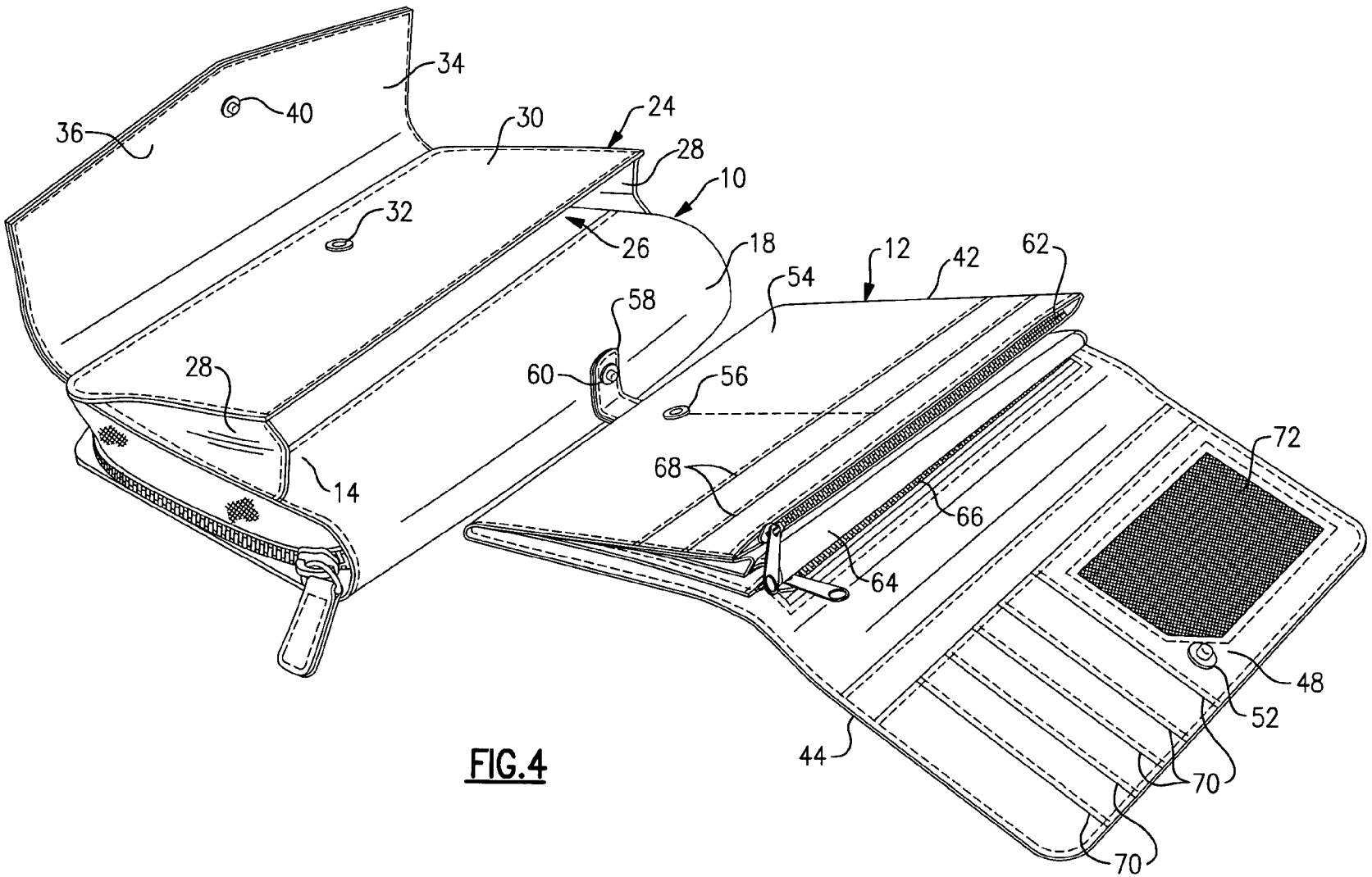
FIG. 4 is a further perspective view of the embodiment of FIG. 1, showing the wallet removed from the binder.

With reference to FIGS. 1–6, binder 10 includes an expandable pocket 24 sewn onto the exterior surface of cover 14. In this embodiment, cover 14 serves as an interior wall for pocket 24 (FIG. 4). Pocket 24 does not have to be an expandable pocket. It may be in any form suitable for receiving a particular ancillary article. In some cases, it may be a simple slot cut into the exterior surface of cover 14. In the present embodiment, pocket 24 is configured and dimensioned to closely receive and support wallet 12. Pocket 24 contains an opening 26, gussets 28, and an exterior panel 30 (FIG. 4). In this particular embodiment, opening 26 is adjacent to spine 18; however, pocket 24 may be oriented in any practical position relative to the casing of binder 10.

As shown in FIGS. 3 and 4, a female snap fastener element 32 is mounted on the exterior surface of panel 30. Snap 32 provides a releasable attachment means with a complementary snap element. Of course, snap 32 does not need to be a snap fastener. It may be some other releasable attachment means, such as a magnetic or hook-and-loop fastener element.

Again, referring to FIGS. 1–6, binder 10 includes a flap 34 sewn on or into cover 14. Flap 34 extends out from cover 14 and is made long enough to overlap, at least partially, the exterior surface of pocket 24 (FIG. 6). Flap 34 has an interior surface 36 (FIG. 3) and an exterior surface 38 (FIG. 1). A male snap fastener element 40 is mounted on interior surface 36. Snap 40 is complementary to snap 32. Snap 40 provides a releasable attachment means with snap 32. Flap 34 is flexible enough and long enough to manually align snap 40 with snap 32 and connect them together, such that flap 34 can be releasable attached and secured to pocket 24.

As shown in FIG. 4, wallet 12 generally includes a body 42 and a flap 44 extending from body 42. In the present embodiment, flap 44 is a closure flap, meaning that it closes an opening or access to the interior of wallet 12. Flap 44 does not have to be a closure flap for the purposes of the claimed invention. Flap 44 has an exterior surface 46 (FIG. 2) and an interior surface 48 (FIG. 3). A female snap fastener element 50 is mounted on exterior surface 46 (FIG. 2) and a male snap fastener element 52 is mounted on interior surface 48 (FIG. 3). Snap 50 is complementary to snap 40 (FIG. 2), i.e., the former being female and the latter being male. Thus, snaps 50 and 40 provide means for releasably attaching binder flap 34 to wallet flap 44. Snap 52 is complementary to snap 32 (FIG. 3), i.e., the former being male and the latter being female. Thus, snaps 52 and 32 provide means for releasably attaching wallet flap 44 to pocket 24.

Wallet body 42 is configured and dimensioned to fit into pocket 24, as shown, e.g., in FIGS. 1–3. As shown in FIG. 4, body 42 includes a front panel 54 on which is mounted a female snap fastener element 56 (FIG. 4). Snap 56 is complementary to snap 52 (FIG. 4), i.e., the former being female and the latter being male. Thus, snaps 56 and 52 provide means for releasably attaching wallet flap 44 to front panel 54, to secure wallet 12 closed. The closure of wallet 12 is further secured by a snap tab 58. Tab 58 includes a male snap element 60 which is complementary and releasably attachable to female snap element 50 (See FIGS. 4 and 6). Tab 58 is sewn on or into wallet body 42, on a side opposite of flap 44 (FIG. 4). As suggested by FIGS. 4 and 6, wallet 12 may be used separately and independently of binder 10.

Figure 5:
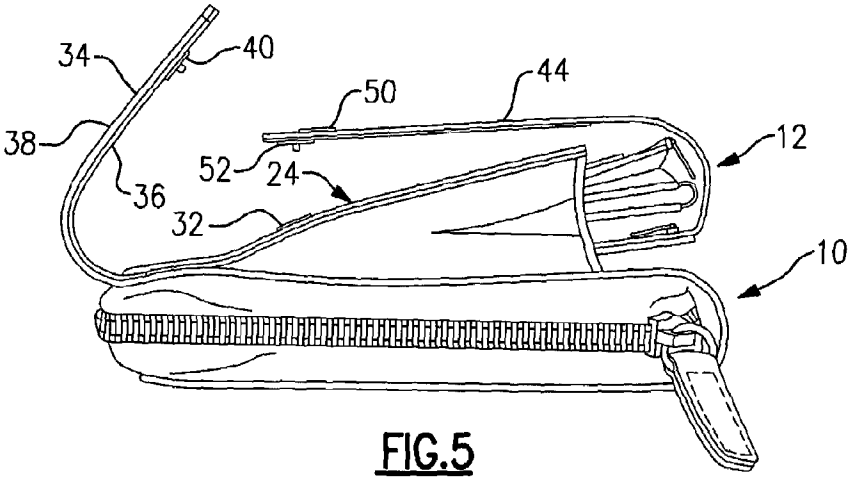
FIG. 5 is a side elevation view of the binder and the wallet of FIG. 1, showing the wallet flap overlapping the binder pocket and the binder flap overlapping the wallet flap.
Figure 6:
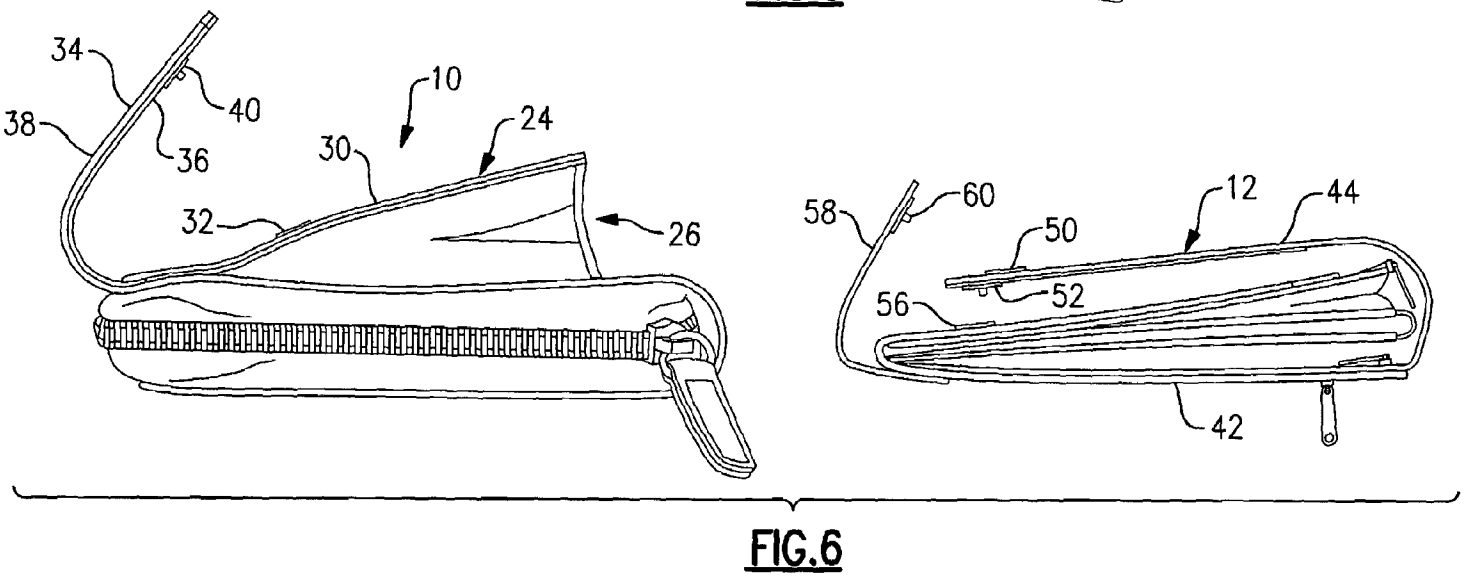
FIG. 6 is a side elevation view of the binder and the wallet of FIG. 1, showing the wallet removed from the binder.

As best shown in FIGS. 5 and 6, wallet flap 44 is adapted to overlap, at least partially, binder pocket 24 such that snap elements 52 and 32 can be aligned and connected together, to releasably secure wallet flap 44 to binder pocket 24. Binder flap 34 is adapted to overlap, at least partially, wallet flap 44 such that snap elements 40 and 50 can be aligned and connected together, to releasably secure binder flap 34 to wallet flap 44.

Thus, it is understood from the above description that an external pocket can be affixed to the casing of an organizer to create a host organizer. An ancillary article can be received in the external pocket and secured there by way of two overlapping (or partially overlapping) and connecting flaps, with one flap being associated with the host organizer and the other with the ancillary article. This dual flap and overlap arrangement provides a strong, yet convenient, means for securing the ancillary article to the host. Such an arrangement is also convenient for removing the ancillary article from the host.

The specific construction and features of wallet 12 are not relevant to the present invention. However, wallet 12 is shown in FIGS. 3 and 4 as having a zippered coin purse 62, billfold 64, zippered pouch 66, utility pockets 68, card pockets 70, and a card display window 72.

The present invention is not defined by any particular form of fastener elements. Snap fasteners are used here by way of example only. Other suitable forms of fastener elements may be used, such as, e.g., magnetic, hook-and-loop, buckle, button, and zipper type fastener elements.

The present invention is not limited to any particular ancillary article or class of such articles. The present invention encompasses any portable or hand-held article useful in connection with the host organizer. For example, a PDA, calculator, electronic organizer, cell phone, checkbook, purse, notebook, etc., could be outfitted with an article flap, like wallet flap 44, and secured to a host organizer. In the case of a PDA, calculator, electronic organizer, or cell phone, for example, such device could be outfitted with a leather or vinyl jacket or case which includes an article flap, like flap 44.

Similarly, the host organizer of the present invention is not limited to a binder. As indicated above, it may take the form of a briefcase, handbag, portfolio case, or similar hand-carried item.

While the preferred embodiments of the invention have been particularly described in the specification and illustrated in the drawings, it should be understood that the invention is not so limited. Many modifications, equivalents and adaptations of the invention will become apparent to those skilled in the art without departing from the spirit and scope of the invention, as defined in the appended claims.

I claim:

1. In combination, a host organizer and an ancillary article removable from said host organizer, said host organizer including an organizer casing having an exterior surface, an organizer pocket located on the exterior surface of the casing, the pocket having an exterior surface on which first releasable attachment means is mounted, and an organizer flap extending from the casing and over at least a portion of the exterior surface of the pocket, the flap having an interior surface on which second releasable attachment means is mounted, the second attachment means being complementary to and alignable with the first attachment means such that the flap is releasably attachable to the pocket;

said ancillary article including an article body, and an article flap extending from the article body, the article flap having interior and exterior surfaces on which third and fourth removable attachment means are mounted, respectively, the third attachment means being complementary to the first attachment means and the fourth attachment means being complementary to the second attachment means, the article body being configured to fit in the organizer pocket, the article flap overlapping the organizer pocket to permit alignment and attachment of the third attachment means with the first attachment means when the article body is in the organizer pocket, such that the article flap is releasably attachable to the organizer pocket, the organizer flap overlapping the article flap to permit alignment and attachment of the second attachment means with the fourth attachment means when the article body is in the organizer pocket, such that the organizer flap is releasably attachable to the article flap.

2. The combination of claim 1, wherein said host organizer is a loose-leaf binder.

3. The combination of claim 1, wherein said ancillary article is a wallet.

4. In combination, a binder and an ancillary article removable from said binder, said binder including a binder cover having an exterior surface, a binder pocket located on the exterior surface of the cover, the pocket having an exterior surface on which first releasable attachment means is mounted, and a binder flap extending from the cover and over at least a portion of the exterior surface of the pocket, the flap having an interior surface on which second releasable attachment means is mounted, the second attachment means being complementary to and alignable with the first attachment means such that the flap is releasably attachable to the pocket;

said ancillary article including an article body, and an article flap extending from the article body, the article flap having interior and exterior surfaces on which third and fourth removable attachment means are mounted, respectively, the third attachment means being complementary to the first attachment means and the fourth attachment means being complementary to the second attachment means, the article body being configured to fit in the binder pocket, the article flap overlapping the binder pocket to permit alignment and attachment of the third attachment means with the first attachment means when the article body is in the binder pocket, such that the article flap is releasably attachable to the binder pocket, the binder flap overlapping the article flap to permit alignment and attachment of the second attachment means with the fourth attachment means when the article body is in the binder pocket, such that the binder flap is releasably attachable to the article flap.

5. The combination of claim 4, wherein said ancillary article is a wallet.

6. In combination, a binder and a wallet removable from said binder, said binder including a binder cover having an exterior surface, a binder pocket located on the exterior surface of the cover, the pocket having an exterior surface on which first releasable attachment means is mounted, and a binder flap extending from the cover and over at least a portion of the exterior surface of the pocket, the flap having an interior surface on which second releasable attachment means is mounted, the second attachment means being complementary to and alignable with the first attachment means such that the flap is releasably attachable to the pocket;

said wallet including a wallet body, and a wallet flap extending from the body, the wallet flap having interior and exterior surfaces on which third and fourth removable attachment means are mounted, respectively, the third attachment means being complementary to the first attachment means and the fourth attachment means being complementary to the second attachment means, the body being configured to fit in the binder pocket, the wallet flap overlapping the binder pocket to permit alignment and attachment of the third attachment means with the first attachment means when the wallet body is in the binder pocket, such that the wallet flap is releasably attachable to the binder pocket, the binder flap overlapping the wall flap to permit alignment and attachment of the second attachment means with the fourth attachment means when the wall body is in the binder pocket, such that the binder flap is releasably attachable to the wallet flap.

7. The combination of claim 6, wherein the binder cover forms an Interior wall of said binder pocket.

8. The combination of claim 6, wherein the first, the second, the third, and the fourth attachment means are snap fastener elements.

9. The combination of claim 6, wherein the wallet flap is a closure flap for said wallet.

10. The combination of claim 6, wherein the wallet body is configured to Fit substantially inside the binder pocket.

11. The combination of claim 6, wherein said binder is a loose-leaf binder.

12. The combination of claim 6, wherein said binder further includes a spine, the binder cover being movably mounted to the spine, and wherein the binder pocket contains a pocket opening, the pocket opening being adjacent to the spine.

* * * * *